United States Patent [19]

Müller

[11] 4,121,867

[45] Oct. 24, 1978

[54] HOOKS, ESPECIALLY FOR CHAINS

[75] Inventor: Anton Müller, Aalen-Unterkochen, Fed. Rep. of Germany

[73] Assignee: Eisen- und Drahtwerk Erlau Aktiengesellschaft, Aalen-Württ, Fed. Rep. of Germany

[21] Appl. No.: 806,812

[22] Filed: Jun. 15, 1977

[30] Foreign Application Priority Data

Jun. 16, 1976 [DE] Fed. Rep. of Germany ..... 2626920

[51] Int. Cl.[2] ..... B66C 1/14

[52] U.S. Cl. ..... 294/82 R; 24/230.5 R

[58] Field of Search ..... 294/82 R, 78 R, 83 R, 294/74 R; 24/230.5 R, 230.5 TP, 232, 233, 234, 235, 241 R, 241 PP, 241 PL, 241 PS, 241 SL, 241 SP, 241 SB, 242

[56] References Cited

U.S. PATENT DOCUMENTS

| | | | |
|---|---|---|---|
| 1,716,918 | 6/1929 | Cot | 24/232 |
| 3,501,817 | 3/1970 | Bambenek et al. | 24/233 |
| 3,575,458 | 4/1971 | Crook et al. | 294/82 R |
| 3,831,229 | 8/1974 | Craven | 24/235 |
| 4,013,314 | 3/1977 | Archer | 294/82 R |

*Primary Examiner*—James B. Marbert
*Attorney, Agent, or Firm*—Walter Becker

[57] ABSTRACT

A hook, particularly an eye hook having a forked head. The hook has a hook body which forms a receiving opening for chain links which are to be suspended therein. The hook also has a closure piece detachably fastened to the hook body and projecting into the receiving opening. The closure piece is rigidly arranged on the hook body in such a way that an introduction opening is formed, the inside diameter of which corresponds to the cross sectional dimension of the chain link taken perpendicular to its annular plane.

6 Claims, 5 Drawing Figures

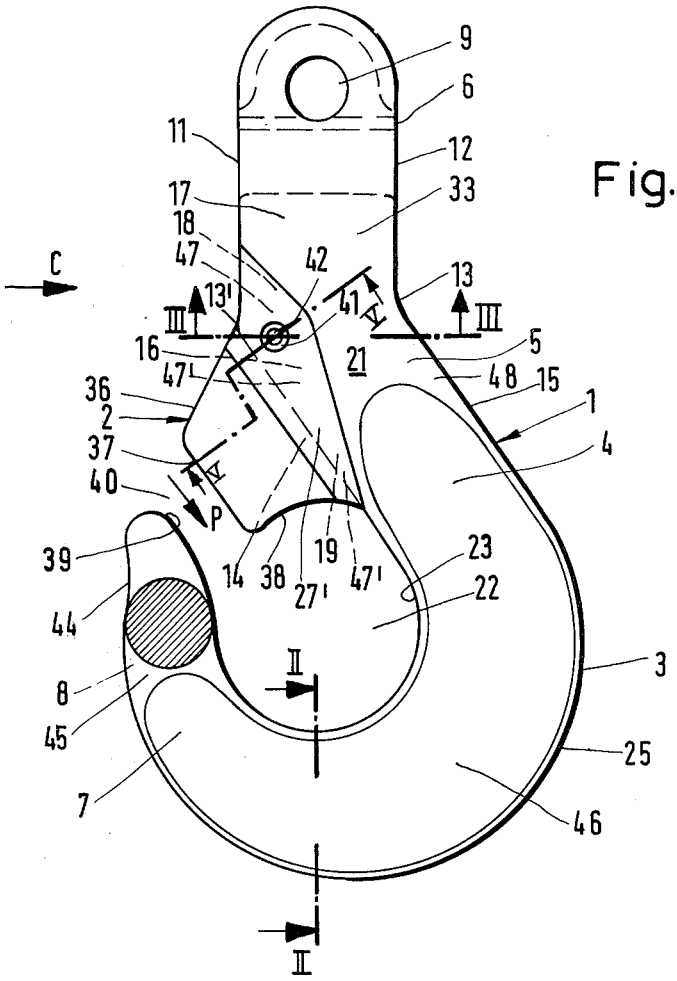
Fig.1
Fig.3
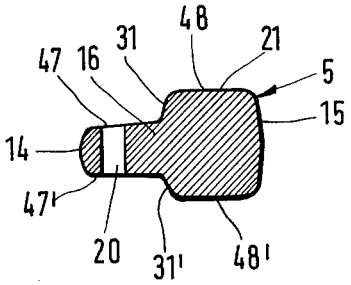
Fig.2
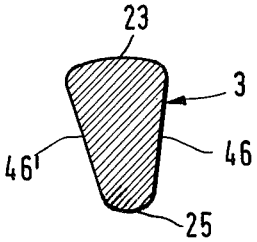

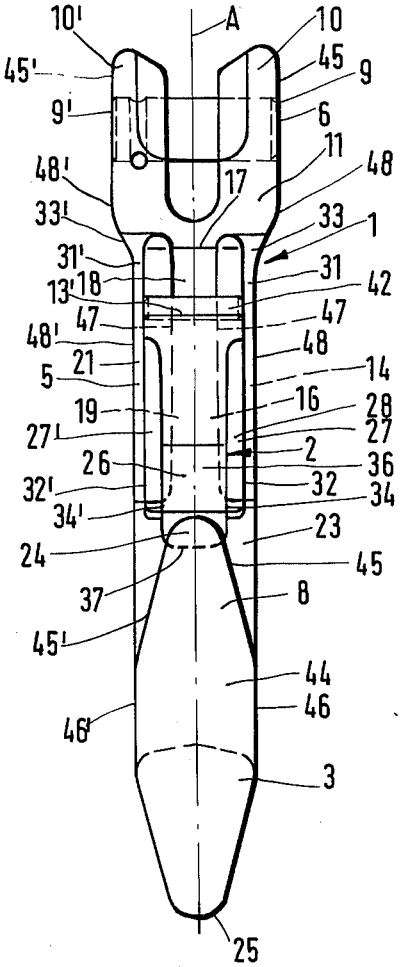
Fig. 4
Fig. 5
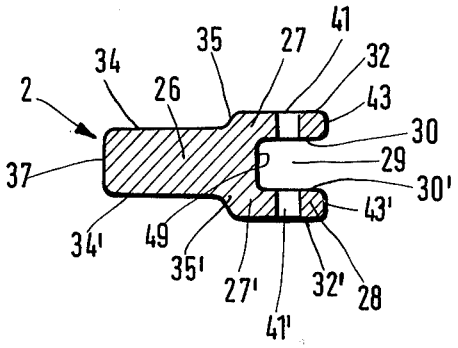

HOOKS, ESPECIALLY FOR CHAINS

The present invention relates to a hook, particularly an eye hook having a forked head, having a hook body forming a receiving opening for chain segments which are to be suspended therein, and having a closure piece detachably fastened to the hook body and projecting at least partially into the receiving opening.

With known hooks of this type, the closure piece is a flap which is held in its position under spring tension for closing the receiving opening.

Since the flap in the closed position extends over the entire width of the receiving opening, but in its open position has to rest closely on the hook body, the flap is relatively flat and long, so that it can absorb only small traction stresses without becoming damaged. These known hooks can therefore be used as load hooks but not as dragging hooks for forestry chains.

It is an object of the present invention to design a hook of this type in such a way that it can be used as a hook for dragging chains.

This object and other objects and advantages of the present invention will appear more clearly from the following specification in connection with the accompanying drawings, in which:

FIG. 1 is a side view of a hook according to the present invention;

FIG. 2 is a section along the line II—II of FIG. 1;

FIG. 3 is a section along the line III—III of FIG. 1;

FIG. 4 is a view in the direction of the arrow C in FIG. 1 and to a larger scale; and FIG. 5 is a section taken along the line V—V of FIG. 1 and to a larger scale.

The hook pursuant to the present invention is characterized primarily in that the closure piece is arranged rigidly on the hook body in such a way that an introduction opening is formed, the clear opening of which corresponds to that cross sectional dimension of the chain segment which is perpendicular to its annular plane.

With construction according to the present invention, a hook suitable for dragging chains is provided, out of which chain segments lying in the receiving opening cannot slip accidentally and for which the same hook body can be used as for a hook for sling chains. Thus the hook body can be produced in larger numbers and with far better utilization of dies, so that the hook itself is extremely reasonable in price.

Referring now to the drawings in detail, the hook shown therein is an eye hook having a forked head and comprises a hook body 1 and a closure piece 2 detachably fastened thereto. The hook body 1 consists essentially of a middle piece 3, bent approximately semi-circularly, which at the end 4, by means of a straight transition section 5, merges into a head piece 6 and at its other end 7 merges into a prong-like end section 8. The head piece 6 is forked and, as shown in FIG. 4, is substantially U-shaped and has an eye formed by aligned bores 9, 9' in its fork arms 10, 10' for receiving a securing pin or the like. The end faces 11 and 12 of the forked head 6 merge into the corresponding end faces 14 and 15 of the transition section 5 by means of bends 13, 13'. In its front area, which faces the prong 8, the hook body 1 is reduced in thickness so as to form a fastening web piece 16 for receiving the closure piece 2.

As shown in FIGS. 1 and 4, the fastening piece 16 extends as far as the forked or transverse web piece 17 of the forked head 6 and over the entire height of the transition section 5. The fastening piece 16 has, as shown in FIG. 1, the shape of an unequal-sided kite-shaped quadrangle, the shorter diagonal of which is at the level of the bends 13, 13' and extends almost over half of the width of the transition section 5. The upper part 18 of the fastening piece 16 in the region of the web piece 17 is approximately half as high as the part 19 in the region of the transition section 5. The fastening piece 16 has a bore 20 which is perpendicular to the longitudinal middle plane A of the hook body 1. The axis of the bore 20 extends slightly below the bends 13, 13' and approximately at half the width of the fastening piece 16. The fastening piece 16, over its entire height, has the same thickness and rectangular cross-section; the remaining part 21 of the transition section 5 has a substantially square cross-section with rounded corners (FIGS. 3 and 4). As shown in FIGS. 3 and 4, the side faces 47, 47' of the fastening piece 16 and the side faces 33, 33' and 48, 48' of the web piece 17 and of the remaining transition section part 21 respectively merge with one another by means of rounded shoulder faces 31, 31'. The shoulder faces 31, 31' serve as counter faces on which the closure piece 2 is supported by corresponding supporting or end faces 43, 43'.

The middle piece 3 of the hook body 1 defines a receiving opening 22 for chain links or segments which are to be suspended therein. The middle piece 3, over its entire length, has the same approximately trapezoidal cross-section with rounded corners (FIG. 2). The longer base side of the trapezoidal cross-section, in the direction toward the center of curvature of the receiving opening 22, is curved slightly convexly and forms the wall 23 bounding the receiving opening 22. At that end 7 facing away from the transition section 5, the middle piece 3 merges continuously with the prong 8 of the hook body 1. The prong 8 has a circular cross-section and tapers in the direction toward its free prong end 24, which is approximately hemisperhical.

The closure piece 2, which projects into the receiving opening 22, is rigidly fastened to the fastening piece 16 of the hook body 1. The closure piece 2 forms a nose piece with a forward solid nose body 26 which projects into the receiving opening 22 and a rear nose body 28 forming a profiled part. The forward nose body 26 has over its entire length a rectangular cross-section; the rear nose body 28 has a U-shaped cross-section (FIG. 5). The nose flanks 27, 27' of the closure piece 2 are formed by the legs of the rear nose body 28 and are respectively similarly formed. The nose flanks 27, 27' have respective bores 41, 41' corresponding to the bore 20 of the fastening piece 16, which bores 41, 41' in the assembled state are in alignment with one another and receive a securing member, preferably a clamping sleeve 42, for fastening the closure piece 2 to the hook body 1. The rear nose body 28, with its inner faces 30, 30' and 49, defines a contact groove 29 into which the fastening piece 16 projects. The nose flanks 27, 27', in side view (FIG. 1), have a contour corresponding to that of the fastening piece 16. The inner faces 30, 30' are spaced from one another by a distance corresponding to the thickness of the fastening piece 16, so that the closure piece 2 is held free of play and immovable on the fastening piece 16.

The entire rear side of the closure piece 2 is supported by the end faces 43, 43' of its legs 27, 27' on the shoulder faces 31, 31' of the hook body 1. The end faces 43, 43' which serve as supporting faces, have a slightly smaller width than the shoulder faces 31, 31' of the forked or web piece 17 and the transition section 5, so that they do not project beyond the side faces 33, 33' and 48, 48' of the forked piece 17 and the transition section 21 and therefore do not form abutting edges on which the chain links can rub and become damaged.

The forward nose body 26, as shown in FIG. 1, has a substantially trapezoidal profile and is arranged on the hook body 1 in such a way that the smaller base side of the trapezoidal cross-section forms the end face 37 of the nose 2 and faces the prong 8; the closure piece 2 tapers therefore in the direction toward the prong 8. Thus the hook has a relatively large receiving opening in which a suspended chain link can turn unimpeded.

The side faces 34, 34' and 32, 32' of the forward and rear nose bodies 26 and 28 merge with each other by means of rounded shoulder faces 35, 35'. The backs 36, the end face 37, and the underside 38 of the nose 2 merge likewise by means of rounded edges, so that the nose 2 has no sharp edges on which the chain links, during introduction or during movement in the receiving opening, can be damaged.

The underside 38 of the nose 2 merges substantially continuously with the wall 23 of the receiving opening 22 and, in the direction toward its center of curvature, is partially circularly, concavely curved, preferably with a larger radius of curvature. Thus a suspended chain link is freely movable over the entire contact area of the receiving opening and is therefore, like the hook itself, subjected to only a small amount of wear.

The end face 37 of the nose 2 forms with the opposite inner side 39 of the prong 8 an introduction opening 40 of the hook. The inner side 39 of the prong 8 is curved slightly convexly in the direction toward the end face 37 of the nose so that the introduction opening widens in the direction of insertion (arrow P), so that the chain links to be suspended can be inserted particularly easily. The shortest distance of the inner side 39 of the prong 8 from the end face 37 of the nose 2 corresponds to the cross-sectional dimension of the suspended chain links measured perpendicular to their annular plane. The suspended chain links can therefore only be inserted into the introduction opening if their annular plane lies in the same plane with the longitudinal middle plane of the introduction opening.

In the receiving opening 22, the chain link adopts a position which differs from its introduction position in that it is turned about an axis perpendicular to the middle longitudinal plane of the introduction opening, so that the link can no longer be moved out of the introduction opening and therefore can no longer slip accidentally out of the hook. The hook body 1 may therefore be used not only as a load hook for sling chains but also, preferably, as a dragging hook for forestry chains. If the hook is used as a dragging hook, the receiving opening is engaged not by an end link of a chain, but by a middle chain link.

Since the nose 2 with the end faces 43, 43' and its nose flanks 27, 27' is supported on the pertaining shoulder faces 31, 31' of the hook body 1, the nose 2 cannot move relative to the hook body 1 and cannot rotate about the axis of the securing part 42 even if a traction force is exerted by a suspended chain link on the underside 38.

Since the closure piece in the region of the receiving opening is solid and has a large surface contact face determined by the inner faces 30, 30' of the nose flanks 27, 27', and has a support on the hook body extending over the entire length of its rear side 43, 43' and 49, which support extends from the transition area 5 to the head piece 6, the closure piece has a very secure fit and is only slightly stressed. Therefore, great traction and shearing forces can be absorbed without the secure hold being adversely affected and the closure piece itself being damaged. Particularly advantageous are the angular course of the supporting faces 43, 43' of the legs 27, 27' of the closure piece, and the counterfaces on the hook body, which counterfaces are respectively formed by two single faces which are arranged at an obtuse angle to one another. As a result thereof, the length of the supporting faces is greater than a planar supporting face, producing a large surface support and particularly favorable force conditions, so that a long life of the hook body and of the securing part can be insured.

The hook has a substantially continuous outer surface. Its front side is formed by the flat front faces 11, 36 and 37 of the forked head 6 and of the closure piece 2. These front faces merge continuously into the curved underside 38 of the closure piece 2, the wall 23 and the inner side 39 of the prong 8. The wall 23 and the inner side 39 are curved convexly outwardly, so that suspended chain links can be moved easily and with slight friction in the receiving opening 22, and the chain can move transverse to the longitudinal middle plane A of the hook body and with slight resistance into the receiving opening. The rear side of the hook is formed by the rear side 12 and 15 of the forked head 6 and the transition section 5, which are preferably curved slightly convexly outwardly and merge continuously into the substantially narrower rear sides 25 (FIG. 2) and 44 of the middle piece 3 and the prong 8. The side faces 33, 33', 48, 48' of the forked head 6 and the transition section 5, as well as the side faces 46, 46' of the middle piece 3, are flat and merge continuously into the curved outer faces 45, 45' of the prong 8. The hook body 1 has its greatest thickness in the region of the forked head 6 (FIG. 4).

It is, of course, to be understood that the present invention is by no means limited to the specific showing of the drawings, but also encompasses any modifications within the scope of the appended claims.

What I claim is:

1. A dragging hook for forestry chains, especially for engaging chain links, which comprises:

a hook body having a receiving opening adapted to receive said chain links; and a closure piece detachably and rigidly fastened in a cap-manner to said hook body and including a blocking part in the form of a forward nose body projecting at least partially into said receiving opening, said hook body having a portion thereof located opposite the free end of that portion of said closure piece which projects into said receiving opening so as to form therewith an entrance passage to said receiving opening having an inlet, said free end of said closure piece being spaced from said oppositely located portion of said hook body by a distance corresponding to the cross sectional dimension of that portion of said chain link which is to be engaged by said hook, said cross sectional dimension being taken perpendicular to the annular plane of said chain link.

2. A dragging hook for forestry chains according to claim 1, in which said blocking part is a solid forward nose body and also includes a rear nose body therewith which has a U-shaped profile.

3. A dragging hook for forestry chains according to claim 2, wherein said rear nose body is connected to said hook body in a form-closing positive manner.

4. A dragging hook for forestry chains according to claim 2, wherein said rear nose body is higher than said forward nose body, said rear nose body including legs having free supporting faces and said hook body having angularly embodied counter surfaces against which said supporting faces engage.

5. A dragging hook for forestry chains according to claim 1, in which portion of said closure piece which projects into said receiving opening in side view has an approximately trapezoidal shape, the shorter base side of which forms said free end.

6. A dragging hook for forestry chains according to claim 1, wherein said closure piece tapers from said hook body toward the inlet of the receiving opening.

* * * * *